US006830859B2

(12) United States Patent
Shiraishi et al.

(10) Patent No.: US 6,830,859 B2
(45) Date of Patent: Dec. 14, 2004

(54) CHARGE CONTROL AGENT AND TONER USING SAME

(75) Inventors: Keiko Shiraishi, Susono (JP); Masanori Suzuki, Sunto-gun (JP); Yohichiroh Watanabe, Fuji (JP); Toyoshi Sawada, Odawara (JP); Takuya Saito, Numazu (JP); Tatsuhiko Osaki, Toyohashi (JP); Satoshi Aratani, Gamagoori (JP); Hiroki Ogiso, Gamagoori (JP)

(73) Assignees: Ricoh Company, Ltd., Tokyo (JP); Takemoto Yushi Kabushiki Kaisha, Gamagoori (JP)

( * ) Notice: Subject to any disclaimer, the term of this patent is extended or adjusted under 35 U.S.C. 154(b) by 180 days.

(21) Appl. No.: 10/163,530

(22) Filed: Jun. 7, 2002

(65) Prior Publication Data

US 2003/0077534 A1 Apr. 24, 2003

(30) Foreign Application Priority Data

Jun. 7, 2001 (JP) ..... 2001-172956
Sep. 21, 2001 (JP) ..... 2001-290197

(51) Int. Cl.[7] ..... G03G 9/097

(52) U.S. Cl. ..... 430/108.3; 430/108.4; 430/108.5; 558/44; 252/519.21

(58) Field of Search ..... 430/108.3, 108.4, 430/108.5; 558/44; 252/519.21, 519.2, 519.4, 519.5, 500

(56) References Cited

U.S. PATENT DOCUMENTS 4,083,894 A * 4/1978 Kusunose et al.
4,762,763 A * 8/1988 Nomura et al. ..... 430/108.3
4,908,290 A 3/1990 Watanabe et al.
4,956,258 A 9/1990 Watanabe et al.
5,168,028 A 12/1992 Nanya et al.
5,288,577 A 2/1994 Yamaguchi et al.
5,368,972 A 11/1994 Yamashita et al.
5,429,901 A 7/1995 Muto et al.
6,004,715 A 12/1999 Suzuki et al.
6,010,814 A 1/2000 Kotsugai et al.
6,074,795 A 6/2000 Watanabe et al.
6,103,441 A 8/2000 Tomita et al.
6,180,298 B1 1/2001 Kuroda et al. ..... 430/45
6,228,550 B1 5/2001 Matsuda et al.
6,335,137 B1 1/2002 Suzuki et al. ..... 430/110.1

FOREIGN PATENT DOCUMENTS

EP 201340 * 11/1986 ..... 430/108.5

OTHER PUBLICATIONS

U.S. Appl. No. 10/251,855, Sawada et al., filed Sep. 23, 2002.
U.S. Appl. No. 10/329,362, Suzuki et al., filed Dec. 27, 2002.
U.S. Appl. No. 09/988,142, filed Nov. 19, 2001, pending.
U.S. Appl. No. 09/993,606, filed Nov. 27, 2001, pending.
U.S. Appl. No. 09/891,652, filed Jun. 26, 2001, pending.
U.S. Appl. No. 09/862,446, filed May 23, 2001.
U.S. Appl. No. 10/102,629, filed Mar. 22, 2002, pending.
U.S. Appl. No. 10/079,878, filed Feb. 22, 2002, pending.
U.S. Appl. No. 09/820,609, filed Mar. 30, 2001, pending.
U.S. Appl. No. 10/314,241, filed Dec. 9, 2002, pending.
U.S. Appl. No. 10/163,530, Shiraishi et al., filed Jun. 7, 2002.
U.S. Appl. No. 10/444,013, Sawada et al., filed May 23, 2003.

* cited by examiner

*Primary Examiner*—Janis L. Dote
(74) *Attorney, Agent, or Firm*—Oblon, Spivak, McClelland, Maier & Neustadt, P.C.

(57) ABSTRACT

A charge control agent containing a barium salt of a sulfoisophthalic acid compound and optionally a metal salt of a salicylic acid compound. A toner for developing an electrostatic latent image comprising such a charge control agent, a binder resin and a colorant.

12 Claims, No Drawings

CHARGE CONTROL AGENT AND TONER USING SAME

FIELD OF THE INVENTION

This invention relates to a charge control agent useful for controlling triboelectricity of a toner for developing an electrostatic latent image. The present invention is also directed to a toner for use in developing an electrostatic latent image in an image forming method such as electrophotography and electrostatic printing.

DESCRIPTION OF PRIOR ART

Methods for developing an electrostatic latent image to form a toner image include a method using a one-component type developer composed only of a toner and a method using a two-component type developer composed of a toner and a carrier which are charged in opposite polarity. The one-component type method may be, for example, a powder cloud developing method in which toner particles are sprayed over an electrostatic latent image-bearing surface, a contact developing method (touch down method) in which a latent image-bearing surface is directly contacted with a bed of toner, or a dielectric developing method in which a latent image-bearing surface is contacted with a magnetic, electrically conductive toner. The two-component type method may be, for example, a magnet brush method using iron powder as a carrier, a cascade method in which glass beads are used as a carrier or a fur brush method in which a fiber brush is used as a carrier.

In the above developing systems, fine particles each composed of a matrix of a synthetic or natural binder resin, such as a polystyrene resin, and a colorant, such as carbon black, dispersed in the matrix are generally used as a toner. Such a toner is finely divided into a particle size of, for example, 1–30 $\mu$m. In the case of a magnetic toner, a magnetic material such as magnetite is incorporated into the above toner.

Toner to be used for developing an electrostatic latent image is positively or negatively charged according to the polarity of the electrostatic latent image to be developed. Because the amount of charges generated by using the triboelectricity of the binder resin is small, a charge control agent is generally incorporated into the toner to obtain clear images.

Known charge controlling agents include metal complexes of monoazo dyes; humic or nitrohumic acid or a salt thereof; metal complexes (e.g. Ni, Co, Cr, and Fe metal complexes) of aromatic hydroxycarboxylic or dicarboxylic acids such as salicylic acid, naphthoic acid and dicarboxylic acid; sultonated copper phthalocyanine pigments; nitrified or halogenated styrene oligomers; chlorinated paraffins; and melamine resins. The known charge controlling agents, however, suffer from one or more defects such as non-uniformity in triboelectricity and susceptibility to decomposition during kneading.

JP-A-HO1-306861 discloses the use of an organic boron compound as a charge control agent. JP-A-S61-3149 discloses the use of a bisphenol compound as a charge control agent. These charge control agents are, however, hygroscopic in nature and are apt to cause a change in their triboelectricity. Additionally, they do not have sufficiently high saturation triboelectricity.

Incidentally, a polyester resin or an epoxy resin is now increasingly used as a binder resin for toners because of their advantages that these resins do not adversely affect the inherent color of colorants thereof, that these resins have good resistance to tackiness to polyvinyl chloride mats and that these resins have good preservation stability and yet permit low temperature fixation. When these binder resins are used in conjunction with the above known charge control agents, sufficiently high triboelectricity cannot be obtained or the triboelectricity gradually reduces even when the initial triboelectricity is high, so that problems of fatigue or toner dispersion are apt to be caused. Probably, the problems are attributed to the presence of —COOH and —OH functional groups in these resins which groups would prevent maintenance of stable triboelectricity of the charge control agents.

(1) Freedom of Hot Offset

Conventionally, an oil is applied to a heated roll to prevent "hot offset" which is a phenomenon occurring in fixation of toner image on paper with a heated roll and refers to deposition of fused toner onto the heated roll. The use of the oil requires the installation of an oil tank and hinders compactness of the apparatus. Recent trend is toward incorporation of a wax into the toner for improving releasability. The use of wax, however, reduces the fluidity of the toner particles and, hence, it becomes difficult to obtain desired amount of charge in a moment by friction. Since the frictional contact time in the case of a one-component type toner is much shorter than that for a two-component type toner, there is a great demand for a charge control agent having excellent triboelectricity.

Additionally, there is an increasing demand for white or colorless charge control agents which can be suitable used for color toners.

SUMMARY OF THE INVENTION

It is, therefore, an object of the present invention to provide a charge control agent which, when incorporated into toner particles, can provide a triboelectricity suitable for a given image developing system upon frictional contact between toner particles, between toner and carrier, between toner and a developer bearing member (such as a developer sleeve) and between toner and a developer adjusting member (such as a doctor blade) and which can maintain the triboelectricity in a stable manner.

Another object of the present invention is to provide a charge control agent of the above-mentioned type which can afford suitable triboelectricity in a moment irrespective of presence or absence of a releasing agent and of difference is the developing system.

It is a further object of the present invention to provide a charge control agent which can be suitably used for both one-component type and two-component type developers.

It is yet a further object of the present invention to provide a charge control agent which can provide stable triboelectricity even placed in different environmental conditions.

It is yet a still further object of the present invention to provide a charge control agent which do not adversely affect the color tone of a colorant conjointly contained in toner.

It is a further object of the present invention to provide a charge control agent which has a good heat resistance and can withstand kneading conditions for the preparation of toners.

It is a further object of the present invention to provide a charge control agent which has poor affinity with moisture.

It is a further object of the present invention to provide a charge control agent which is cheap and can reduce the cost of the toner.

It is an important object of the present invention to provide a toner containing the above charge control agent and exhibiting excellent properties attributed to the charge control agent.

In accomplishing the foregoing objects, there is provided in accordance with one aspect of the present invention a charge control agent comprising a barium salt of a sulfoisophthalic acid compound represented by the following formula (1):

(1)

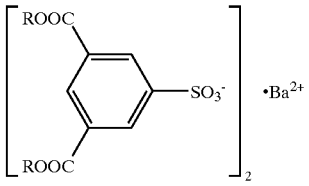

wherein R is a hydrogen atom or a hydrocarbyl group having 1 to 8 carbon atoms.

In another aspect, the present invention provides a charge control agent as described above, which further comprises a metal salt of a salicylic acid compound, wherein the metal of a salicylic acid compound is other than a barium salt.

The present invention also provides a toner for developing an electrostatic latent image, comprising a binder resin, a colorant and a charge control agent as defined above.

Other objects, features and advantages of the present invention will become apparent from the detailed description of the preferred embodiments of the invention to follow.

DETAILED DESCRIPTION OF THE PREFERRED EMBODIMENTS OF THE INVENTION

The charge control agent of the present invention comprises a barium salt of a sulfoisophthalic acid compound represented by the following formula (1):

(1)

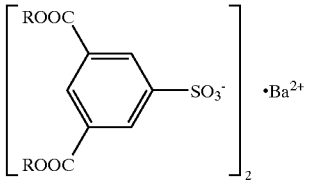

wherein R is a hydrogen atom or a hydrocarbyl group having 1 to 8 carbon atoms.

In the above formula (1), the hydrocarbyl group R may be a linear aliphatic hydrocarbon group such as methyl, ethyl, n-propyl, i-propyl, n-butyl, t-butyl, n-pentyl, n-hexyl, n-heptyl or n-octyl, a cyclic aliphatic hydrocarbon group such as cyclohexyl, an aryl group such as phenyl or an aralkyl group such as benzyl. For reasons of stability in triboelectricity, a dimethyl ester represented by the following formula (2):

(2)

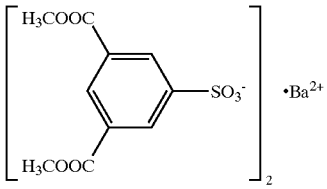

is preferably used as the barium salt of a sulfoisophthalic acid compound.

Specific examples of the barium salt of a sulfoisophthalic acid compound of the above formula (1) include 5-sulfoisophthalic acid barium salt (compound of the above formula (1) in which R is a hydrogen atom), dimethyl 5-sulfoisophthalate barium salt (compound of the above formula (2)), diethyl 5-sulfoisophthalate barium salt, dipropyl 5-sulfoisophthalate barium salt, diisopropyl 5-sulfoisophthalate barium salt, dibutyl 5-sulfoisophthalate barium salt, diisobutyl 5-sulfoisophthalate barium salt, di-t-butyl 5-sulfoisophthalate barium salt, dipentyl 5-sulfoisophthalate barium salt, di-1-methylbutyl 5-sulfoisophthalate barium salt, di-1-ethylpropyl 5-sulfoisophthalate barium salt, diisoamyl 5-sulfoisophthalate barium salt, di-2,2-dimethylpropyl 5-sulfoisophthalate barium salt, dihexyl 5-sulfoisophthalate barium salt, di-1-methylpentyl 5-sulfoisophthalate barium salt, di-1-ethylbutyl 5-sulfoisophthalate barium salt, di-1,3-dimethylbutyl 5-sulfoisophthalate barium salt, di-1,1,2-trimethylpropyl 5-sulfoisophthalate barium salt, 1,2,2-trimethylpropyl 5-sulfoisophthalate barium salt, diheptyl 5-sulfoisophthalate barium salt, di-1-methylhexyl 5-sulfoisophthalate barium salt, di-1,1-dimethylpentyl 5-sulfoisophthalate barium salt, bis-diisopropylmethyl 5-sulfoisophthalate barium salt, dioctyl 5-sulfoisophthalate barium salt, di-1-methylheptyl 5-sulfoisophthalate barium salt, di-1-ethylhexyl 5-sulfoisophthalate barium salt, di-1-ethyl-3-methylpentyl 5-sulfoisophthalate barium salt and di-2-ethylhexyl 5-sulfoisophthalate barium salt.

It is preferred that the barium salt of a sulfoisophthalic acid compound represented by the following formula (1) be used in conjunction with a metal salt of a salicylic acid compound, wherein the metal of a salicylic acid compound is other than a barium salt, for reasons of stability in triboelectricity, reduction of costs and, when applied to a wax-containing toner, improvement of dispersibility of the wax in the toner. Such an improvement in wax dispersibility is advantageous because deposition of the wax to carrier particles, a developer bearing member (e.g. developing sleeve) and/or a developer regulating member (e.g. doctor blade) is able to be prevented.

The metal salt of a salicylic acid compound is preferably a compound of the following formula (4):

(4)

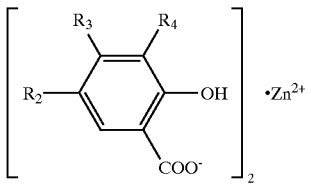

in which $R_2$, $R_3$ and $R_4$ are independently selected from the group consisting of a hydrogen atom, a halogen atom or a hydrocarbyl group having 1 to 6 carbon atoms. Examples of the hydrocarbyl group may include an aliphatic group, alicyclic group, an aryl group and an aralkyl group.

The metal of the metal salt of a salicylic acid compound may be, for example, Al, Zn, Ti, Sr, B, Si, Ni, Fe, Cr and Zr. For reasons of high triboelectricity and whiteness of the color, zinc salts, chromium salts and zirconium salts are preferred. The use of a zinc salt of a salicylic acid compound is particularly preferred. The most preferred salt of a salicylic acid compound is represented by the following formula (3):

(3)

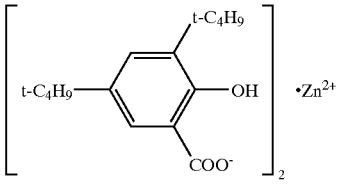

The metal salt of a salicylic acid compound is preferably used in such an amount that the weight ratio of the barium salt of a sulfoisophthalic acid ester to the metal salt of a salicylic acid compound is greater than 1 (namely greater than 50:50), more preferably 61:49 to 98:2, most preferably 85:15 to 95:5, for reasons of good stability such as resistance to high temperature and high humidity.

The charge control agent is suitably applied to a toner for developing an electrostatic latent image. Thus, in one aspect of the present invention, there is provided a toner including a binder resin, a colorant and the above charge control agent. The toner may be used for both a one-component type developer and a two-component developer and may include any ingredients conventionally known for the preparation of toners. Description will be next made of typical ingredients of the toner.

Illustrative of suitable binder resins are homopolymers or copolymers of two or more of the following monomers: styrene or its homologues such as chlorostyrene, vinyltoluene, vinyl chloride, vinyl acetate, vinyl propionate, methyl (meth)acrylate, ethyl (meth)acrylate, propyl (meth) acrylate, n-butyl (meth)acrylate, isobutyl (meth)acrylate, dodecyl (meth)acrylate, 2-ethylhexyl (meth)acrylate, lauryl (meth)acrylate, 2-hydroxyethyl (meth)acrylate, hydroxypropyl (meth)acrylate, 2-chloroethyl (meth)acrylate, (meth) acrylonitrile, (meth)crylamide, (meth)acrylic acid, vinyl ethyl ether, vinyl methyl ether, vinyl isobutyl ether, vinyl methyl ketone, N-vinyl pyrrolidone, N-vinylpyridine and butadiene. Other resins such as polyester resins, polyurethane resins, polyol resins, polyamide resins, epoxy resins, rosins, modified rosins, terpene resins, phenolic resins, hydrogenated petroleum resins, ionomer resins, silicone resins, ketone resins, and xylene resins may also be used. Mixtures of two or more of the above homopolymers, copolymers and resins may also be used.

Polyester resins, epoxy resins and polyol resins obtained from epoxy resins have an advantage over conventionally widely used styrene-acrylate copolymer resins with respect to preservability and fixing properties but are disadvantageous with respect to charging amount. Since the charge control agent according to the present invention has high triboelectricity, polyester resins, epoxy resins or polyol resins can be suitably used as a binder resin for the toner of the present invention. The toner containing these resins can exhibit the above-mentioned advantages of these resins with respect to preservability and fixing properties as well as excellent frictional electrification properties.

Any known colorant may be used for the purpose of the invention. The colorant may be, for example, a black colorant such as carbon black, a nigrosine dye, iron black; a yellow colorant such as Naphthol Yellow S, HANSA YELLOW (10G, 5G, G, GR, A, RN and R), cadmium yellow, Chinese yellow, chrome yellow, yellow iron oxide, titanium yellow, Polyazo Yellow, Oil Yellow, Pigment Yellow L, Benzidine Yellow (G and GR), Permanent Yellow NCG, Vulcan Fast Yellow, Tartradine Lake, Quinoline Yellow Lake, Anthrazan Yellow BGL, Isoindolinone Yellow; a magenta colorant such as red iron oxide, red lead, lead vermilion, cadmium red, cadmium mercury red, antimony vermilion, Permanent Red 4R, Para Red, Fisay Red, parachloro-orthonitroaniline red, LITHOL FAST SCARLET, Brilliant Fast Scarlet, Brilliant Carmine BS, Permanent Red (F2R, F4R, FRL, FRLL and F4RH), Fast Scarlet VD, Vulcan Fast Lubin B, Brilliant Scarlet G, LITHOL LUBIN GX, Permanent Red F5R, Brilliant Carmine 6B, Pigment Scarlet 3B, Bordeaux 5B, Toluidine Maroon, Permanent Bordeaux F2K, Hello Bordeaux BL, Bordeaux 10B, Bon Maroon Light, Bon Maroon Medium, Eosin Lake, Rhodamine Lake B, Rhodamine Lake Y, Alizarmne Lake, Thioindigo Red B, Thioindigo Maroon, Oil Red, Quinacridon Red, Pyrazolon Red, Polyazo Red, chrome vermilion; Benzidine Orange, Perinon Orange, Oil Orange; a cyan colorant such as Cobalt Blue, Selulian Blue, Alkali Blue Lake, Peacock Blue Lake, Victoria Blue Lake, non-metal Phthalocyanine Blue, Phthalocyanine Blue, Fast Sky Blue, Indanthrene Blue (RS and BC), Indigo, Iron Blue, Ultramarine Blue, Anthraquinone Blue, Fast Violet B, Methyl Violet Lake, Cobalt Violet, Manganese Violet, Dioxan Violet, Anthraquinone Violet; Chrome Green, Zinc Green, chromium oxide, Pylidian, Emerald Green, Pigment Green B, Naphthol Green B, Green Gold, Acid Green Lake, Marakite Green Lake, Phthalocyanine Green, Anthraquinone Green; titanium oxide, Chinease White or Lithopone. These colorants may be used by themselves or in combination with two or more. The colorant is generally used in an amount of 0.1 to 50 parts by weight per 100 parts by weight of the binder resin.

The toner of the present invention may contain another charge control agent in addition to the above-described charge control agent for enhancing the chargeability thereof, if desired. Any charge control agent generally used in the field of toners for use in developing an electrostatic latent image may be used for the purpose of the present invention. Examples of such additional charge control agents include a nigrosine dye, a triphenylmethane dye, a chromium-containing metal complex dyer a molybdic acid chelate pigment, a rhodamine dye, an alkoxyamine, a quaternary ammonium salt including a fluorine-modified quaternary ammonium salt, alkylamide, phosphorus and a phosphorus-containing compound, tungsten and a tungsten-containing compound and a fluorine-containing activator material.

The amount of the charge control agent (including the additional charge control agent) used for enhancing the chargeability use in the color toner may be determined in light of the amount of the charge control agent, the kind of binder resin to be employed, the presence or absence of additives, and the preparation method of the toner including the method of dispersing the composition of the toner. It is preferable that the amount of the additional charge controlling agent be in the range of 0.1 to 10 parts by weight, and more preferably in the range of 2 to 5 parts by weight, per 100 parts by weight of the binder resin. By the addition of the additional charge controlling agent in such an amount, sufficient chargeability for use in practice can be imparted to the toner. Further, electrostatic attraction of the toner to a developing roller can be prevented, so that the decrease of fluidity of the developer and the decrease of image density can be prevented.

A releasing agent may be suitably incorporated into the toner. In general, a releasing agent tends to adversely affect the charging characteristics of a developer. For example, during a long period of use, the releasing agent is apt to deposit on surfaces of carriers to reduce the triboelectricity of the developer. In the case of the present invention, the use of the charge control agent having good charging characteristics can inhibit a reduction of charging amount which might be otherwise caused by the releasing agent. The releasing agent also has a problem because a toner containing the releasing agent is slow to establish the desired charging amount. Such a problem may be also overcome by the use of the charge control agent of the present invention.

Any known releasing agent may be suitably used for the purpose of the present invention. Wax is generally used as a releasing agent. Examples of the wax include low molecular weight polyolefin wax such as low molecular weight polyethylene wax and low molecular weight polypropylene wax; synthetic hydrocarbon wax such as Fischer-Tropsh wax; natural wax such as carnauba wax, candelilla wax, rice wax, montan wax; petroleum waxe such as paraffin wax and microcrystalline wax; higher fatty acids such as stearic acid, palmitic acid and millystyric acid; metal salts or amides of higher fatty acids; and modified waxes of the above waxes. These waxes may be used singly or in combination of two or more thereof. It is preferred that the wax have a melting point in the range of 70° C. to 125° C. for reasons of satisfactory transferability, duration and releasability. The releasing agent is generally used in an amount of 1 to 15% by weight based on the weight of the toner.

The toner of the present invention may contain a magnetic material to provide a magnetic toner. The magnetic material may be, for example, iron oxide (e.g. magnetite, ferrite or hematite), metallic cobalt or nickel, an alloy of iron, cobalt and/or nickel with one or more metals such as aluminum, copper, lead, magnesium, tin, zinc, antimony, beryllium, bismuth, cadmium, calcium, manganese, selenium, titanium, tungsten and vanadium. Above all, use of magnetite is preferred. The magnetic particles preferably have an average particle diameter of 0.1 to 2 $\mu$m and are preferably used in an amount of 20 to 200 parts by weight per 100 parts by weight of the binder resin of the toner.

In addition, the toner of the present invention may contain an external additive such as silica powder, metal salts of fatty acids (such as zinc stearate and aluminum stearate), metal oxides (titanium oxide, aluminum oxide, tin oxide and antimony oxide) and fluoropolymers. Especially, hydrophobized silica powder, hydrophobized titania powder and hydrophobized alumina powder are preferred. Especially, as the hydrophobic-treated titanium oxide powder, crystalline titanium oxides including anatase-type titanium oxides and rutile-type titanium oxides, and noncrystalline titanium oxide can be used.

A hydrophobic-treated powder of silica, titania or alumina can be obtained by treating hydrophilic particles thereof with a silane coupling agent such as methyltrimethoxysilane, methyltriethoxysilane, and octyltrimethoxysilane.

The toner of the present invention may be prepared by any conventionally known method. The toner preferably has a volume particle diameter of 4–10 $\mu$m for reasons of prevention of background stains and good fluidity. Granulation may be performed by, for example, pulverization, polymerization in an aqueous medium or a combination thereof.

The toner of the present invention including the above ingredients can be used in combination with a carrier as a two-component developer or alone as a one-component developer.

When the toner is used as a two-component developer, any conventionally known carrier such as iron powder, ferrite particles, and glass beads can be used. These carrier base particles may be coated with a resin. In this case, any conventionally known resin can be used. Specific examples of the resin include acrylic resins, polycarbon fluoride, polyvinyl chloride, polyvinylidene chloride, phenol resins, polyvinyl acetal and silicon resins. The carrier base particles generally has an average particle diameter of 10 to 1000 $\mu$m, preferably 30 to 500 $\mu$m. In general, the toner is mixed with the carrier in an amount of 0.5 to 6.0 parts by weight per 100 parts by weight of the carrier.

The charge control agent according to the present invention may be also used as a surface material which is desired to charge toner particles by frictional contact therewith. In a system for developing an electrostatic latent image using a single component developer, the toner has a smaller chance for frictional electronification as compared with a two-component developer which contains a carrier. Thus, so the toner of the single component developer can be charged sufficiently within a short period of time, the charge control agent may be incorporated into a developer bearing member (developing roller or sleeve), a developer regulating member (doctor blade) for adjusting the thickness of the developer layer on the developer bearing member or a toner feed roller.

The following examples will further illustrate the present invention. Parts are by weight.

PREPARATION EXAMPLE 1

Preparation of 5-sulfoisophthalic Acid Barium Salt

268 Grams of 5-sulfoisophthalic acid sodium salt were placed together with 1600 g of ion exchanged water in a reactor equipped with a stirrer. The contents in the reactor were heated with stirring to 80° C. so that the sodium salt was dissolved in water. A solution of barium chloride dissolved in an amount of 104 g into 900 ml of ion exchanged water was then gradually added dropwise to the thus obtained solution. The resulting mixture was cooled to 30° C. and filtered to separate white precipitates. The precipitates were dispersed in 3000 g of ion exchanged water. The dispersion was heated to 80° C., maintained at that temperature for 1 hour, cooled to 30° C. and then filtered. The precipitates were washed with water. Such a procedure including dispersion, heating, filtration and washing steps was repeated once more. The thus obtained precipitates were dried at 120° C. for 5 hours to obtain 265 g of 5-sulfoisophthalic acid barium salt as a white powder. The atomic absorption analysis revealed that the 5-sulfoisophthalic acid barium salt powder contained 21.9% by weight of barium and 120 ppm by weight of sodium.

PREPARATION EXAMPLE 2

Preparation of Dimethyl 5-sulfoisophthalate Barium Salt

296 Grams of dimethyl 5-sulfoisophthalate sodium salt were placed together with 2000 g of ion exchanged water in a reactor equipped with a stirrer. The contents in the reactor were heated with stirring to 80° C. so that the sodium salt was dissolved in water. A solution of barium chloride dissolved in an amount of 104 g into 900 ml of ion exchanged water was then gradually added dropwise to the thus obtained solution. The resulting mixture was cooled to 30° C. and filtered to separate white precipitates. The precipitates were dispersed in 3000 g of ion exchanged water. The dispersion was heated to 80° C., maintained at that temperature for 1 hour, cooled to 30° C. and then filtered. The precipitates were washed with water. Such a procedure including dispersion, heating, filtration and washing steps was repeated once more. The thus obtained precipitates were dried at 120° C. for 5 hours to obtain 297 g of dimethyl 5-sulfoisophthalate barium salt as a white powder. The atomic absorption analysis revealed that the 5-sulfoisophthalic acid barium salt powder contained 20.1% by weight of barium and 100 ppm by weight of sodium.

EXAMPLE 1

| Preparation of developer: | |
|---|---|
| Styrene-methyl acrylate copolymer resin | 100 parts |
| Carbon black | 10 parts |
| 5-Sulfoisophthalic acid barium salt | 2 parts |

The above ingredients were thoroughly mixed with a HENSCHEL mixer and the mixture was kneaded with a roll mill at 130 to 140° C. for about 30 minutes. The kneaded mixture was solidified by cooling to room temperature and the solid mass was grounded and sieved to obtain base toner particles having a volume average particle diameter of 8.0±0.5 μm. 100 Parts of the base toner particles were mixed with 0.5 part of hydrophobic silica and 0.2 part of titanium oxide as external additives to obtain a toner. The toner (2.5 parts) was mixed with 97.5 parts of iron carrier having a particle size of 100 to 250 mesh using a TURBLER mixer to obtain a developer.

Evaluation

The developer obtained above was charged in a copying machine, IMAGIO MF530, manufactured by Ricoh Company, Ltd. and images were reproduced at room temperature environment. Uniform images having a high image density and free of background stains were obtained in the initial copying stage. No image defects were detected even after production of 50,000 copies. The toner during developing operations was measured for the static charge amount by a blow-off method to reveal that the initial charge amount was −26 μC/g and that the charge amount after production of 50,000 copies was −21 μC/g. Image reproduction was also carried out in a low temperature low humidity environment (10° C., 15% relative humidity) and in a high temperature high humidity environment (30° C., 90% relative humidity). Good images were found to be obtained in these environments, too. The toner during developing operations was measured for the static charge amount by a blow-off method to reveal that the initial charge amount was −28 μC/g in the case of the conditions of 10° C. and 15% relative humidity and −25 μC/g in the case of the conditions of 30° C. and 90% relative humidity. Thus the developer was found to be hardly influenced by environmental conditions.

EXAMPLE 2

| Preparation of developer: | |
|---|---|
| Polyester resin | 100 parts |
| Carbon black | 10 parts |
| 5-Sulfoisophthalic acid barium salt | 2 parts |

Using the above ingredients, a toner was prepared in the same manner as described in Example 1. A developer was then prepared in the same manner as described in Example 1.

Evaluation

The developer obtained above was tested in the same manner as that in Example 1. While the polyester resin binder generally gives a smaller charge amount than a styrene-acrylate resin binder, the initial charge amount was −24 μC/g which was nearly comparable to that in Example 1. Uniform images having a high image density and free of background stains were obtained in the initial copying stage. No image defects were detected even after production of 50,000 copies. The charge amount after production of 50,000 copies was −21 μC/g. Image reproduction was also carried out in a low temperature low humidity environment (10° C., 15% relative humidity) and in a high temperature high humidity environment (30° C., 90% relative humidity). Good images were found to be obtained in these environments, too. The initial charge amount was −25 μC/g in the case of the conditions of 10° C. and 15% relative humidity and −21 μC/g in the case of the conditions of 30° C. and 90% relative humidity. Thus the developer was found to be hardly influenced by environmental conditions.

EXAMPLE 3

| Preparation of developer: | |
|---|---|
| Polyester resin | 70 parts |
| Styrene-butyl acrylate copolymer resin | 30 parts |
| Carbon black | 10 parts |
| Polyethylene wax | 4 parts |
| 5-Sulfoisophthalic acid barium salt | 2.5 parts |

Using the above ingredients, a toner was prepared in the same manner as described in Example 1. The toner thus obtained had a volume average particle diameter of 8.0±0.5 μm. A developer was then prepared in the same manner as described in Example 1.

Evaluation

The developer obtained above was tested in the same manner as that in Example 1 except that a copying machine, MF-2200, manufactured by Ricoh Company, Ltd. was used. The initial charge amount was −27 μC/g notwithstanding the fact that the toner contained a wax, Uniform images having a high image density and free of background stains were obtained in the initial copying stage. No image defects were detected even after production of 50,000 copies. The charge amount after production of 50,000 copies was −24 μC/g. Image reproduction was also carried out in a low temperature low humidity environment (10° C., 15% relative humidity) and in a high temperature high humidity environment (30° C., 90% relative humidity). Good images were found to be obtained in these environments, too. The initial charge amount was −29 μC/g in the case of the conditions of 10° C. and 15% relative humidity and −25 μC/g in the case of the conditions of 30° C. and 90% relative humidity. Thus the developer was found to be hardly influenced by environmental conditions.

EXAMPLE 4

| Preparation of developer: | |
|---|---|
| Polyester resin | 100 parts |
| Carbon black | 10 parts |
| Carnauba wax | 4 parts |
| Dimethyl 5-Sulfoisophthalate barium salt | 2 parts |

Using the above ingredients, a toner was prepared in the same manner as described in Example 1. A developer was then prepared in the same manner as described in Example 1.

Evaluation

The developer obtained above was tested in the same manner as that in Example 3. The initial charge amount was −25 μC/g. Uniform images having a high image density and free of background stains were obtained in the initial copying stage. No image defects were detected even after production of 50,000 copies. The charge amount after production of 50,000 copies was −23 μC/g. Image reproduction was also carried out in a low temperature low humidity environment (10° C., 15% relative humidity) and in a high temperature high humidity environment (30° C., 90% relative humidity). Good images were found to be obtained in these environments, too. The initial charge amount was −26 μC/g in the case of the conditions of 10° C. and 15% relative humidity and −24 μC/g in the case of the conditions of 30° C. and 90% relative humidity. Thus the developer was found to be hardly influenced by environmental conditions.

EXAMPLE 5

| Preparation of developer: | |
|---|---|
| Yellow toner: | |
| Polyol resin | 100 parts |
| Disazo yellow pigment | 5 parts |
| Dimethyl 5-Sulfoisophthalate barium salt | 2 parts |
| Magenta toner: | |
| Polyol resin | 100 parts |
| Quinacridon magenta pigment | 4 parts |
| Dimethyl 5-Sulfoisophthalate barium salt | 2 parts |
| Cyan toner: | |
| Polyol resin | 100 parts |
| Copper phthalocyanin blue pigment | 2 parts |
| Dimethyl 5-Sulfoisophthalate barium salt | 2 parts |
| Black toner: | |
| Polyol resin | 100 parts |
| Carbon black | 6 parts |
| Dimethyl 5-Sulfoisophthalate barium salt | 2 parts |

The above ingredients of each of the toners were thoroughly mixed with a HENSCHEL mixer and the mixture was kneaded with a roll mill at 100 to 110° C. for about 30 minutes. The kneaded mixture was solidified by cooling to room temperature and the solid mass was grounded and sieved to obtain base toner particles having a volume average particle diameter of 8.0±0.5 μm. 100 Parts of the base toner particles were mixed with 0.7 part of hydrophobic silica and 0.6 part of titanium oxide as external additives to obtain a toner. The toner (5 parts) was mixed with 95 parts of iron carrier having a particle size of 100 to 250 mesh using a TURBLER mixer to obtain a developer. The above procedures were conducted for each of the four color toners to obtain four kinds of developer.

Evaluation

Each of the developers obtained above was charged in a copying machine, PRITER 550, manufactured by Ricoh Company, Ltd. and full color images were reproduced at room temperature environment. Uniform images having a high image density and good color tone and free of background stains were obtained in the initial copying stage. No image defects were detected even after production of 30,000 copies. The magenta toner during developing operations was measured for the static charge amount by a blow-off method to reveal that the initial charge amount was −22 μC/g and that the charge amount after production of 30,000 copies was −23 μC/g. Image reproduction was also carried out in a low temperature low humidity environment (10° C., 15% relative humidity) and in a high temperature high humidity environment (30° C., 90% relative humidity). Good images were found to be obtained in these environments, too. The toner during developing operations was measured for the static charge amount by a blow-off method to reveal that the initial charge amount was −24 μC/g in the case of the conditions of 10° C. and 15% relative humidity and −19 μC/g in the case of the conditions of 30° C. and 90% relative humidity. Thus the developer was found to be hardly influenced by environmental conditions.

EXAMPLE 6

| Preparation of developer: | |
|---|---|
| Yellow toner: | |
| Polyol resin | 100 parts |
| Disazo yellow pigment | 5 parts |
| Carnauba wax | 4 parts |
| Dimethyl 5-Sulfoisophthalate barium salt | 2 parts |
| Magenta toner: | |
| Polyol resin | 100 parts |
| Quinacridon magenta pigment | 4 parts |
| Carnauba wax | 4 parts |
| Dimethyl 5-Sulfoisophthalate barium salt | 2 parts |
| Cyan toner: | |
| Polyol resin | 100 parts |
| Copper phthalocyanin blue pigment | 2 parts |
| Carnauba wax | 4 parts |
| Dimethyl 5-Sulfoisophthalate barium salt | 2 parts |
| Black toner: | |
| Polyol resin | 100 parts |
| Carbon black | 6 parts |
| Carnauba wax | 4 parts |
| Dimethyl 5-Sulfoisophthalate barium salt | 2 parts |

Using the above ingredients, four kinds of toners were prepared in the same manner as described in Example 5. Four kinds of developers were then prepared in the same manner as described in Example 5.

Evaluation

Each of the developers obtained above was tested in the same manner as that in Example 5. Uniform images having a high image density and good color tone and free of background stains were obtained in the initial copying stage. No image defects were detected even after production of 30,000 copies. The magenta toner during developing operations was measured for the static charge amount by a blow-off method to reveal that the initial charge amount was −23 μC/g and that the charge amount after production of 30,000 copies was −22 μC/g. Image reproduction was also carried out in a low temperature low humidity environment (10° C., 15% relative humidity) and in a high temperature high humidity environment (30° C., 90% relative humidity). Good images were found to be obtained in these environments, too. The toner during developing operations was measured for the static charge amount by a blow-off method to reveal that the initial charge amount was −23 μC/g in the case of the conditions of 10° C. and 15% relative humidity and −21 μC/g in the case of the conditions of 30° C. and 90% relative humidity. Thus the developer was found to be hardly influenced by environmental conditions.

COMPARATIVE EXAMPLE 1

| Preparation of developer: | |
|---|---|
| Polyester resin | 100 parts |
| Carbon black | 10 parts |
| Polyethylene wax | 4 parts |
| Dimethyl 5-Sulfoisophthalate sodium salt | 3 parts |

Using the above ingredients, a toner was prepared in the same manner as described in Example 1. A developer was then prepared in the same manner as described in Example 1.

Evaluation

The developer obtained above was tested in the same manner as that in Example 3. The initial charge amount was −22 μC/g. Uniform images having a high image density and free of background stains were obtained in the initial copying stage. However, background stains were detected after production of 50,000 copies. The charge amount after production of 50,000 copies was −16 μC/g. Image reproduction was also carried out in a low temperature low humidity environment (10° C., 15% relative humidity) and in a high temperature high humidity environment (30° C., 90% relative humidity). In the case of the conditions of 10° C. and 15% relative humidity, good images were found to be obtained and the initial charge amount was −25 μC/g. In the case of the conditions of 30° C. and 90% relative humidity, on the other hand, background stains occurred significantly and the initial charge amount was −14 μC/g. Thus the developer was found to be greatly influenced by environmental conditions.

COMPARATIVE EXAMPLE 2

| Preparation of developer: | |
|---|---|
| Polyester resin | 100 parts |
| Carbon black | 10 parts |
| Carnauba wax | 5 parts |
| Salicylic acid barium salt | 3 parts |

Using the above ingredients, a toner was prepared in the same manner as described in Example 1. A developer was then prepared in the same manner as described in Example 1.

Evaluation

The developer obtained above was tested in the same manner as that in Example 3. The initial charge amount was −23 μC/g. The charge amount after production of 50,000 copies was −18 μC/g. Satisfactory image quality was obtained even after production of 50,000 copies. However, background stains were found when the make up toner was added. This was considered to be attributed to the fact that the toner was not able to provide required charge within a short period of time. Image reproduction was also carried out in a low temperature low humidity environment (10° C., 15% relative humidity) and in a high temperature high humidity environment (30° C., 90% relative humidity). In the case of the conditions of 10° C. and 15% relative humidity, good images were found to be obtained and the initial charge amount was −25 μC/g. In the case of the conditions of 30° C. and 90% relative humidity, on the other hands background stains occurred significantly and 6 the initial charge amount was −14 μC/g. Thus, the developer was found to be greatly influenced by environmental conditions.

EXAMPLE 7

| Preparation of toner: | |
|---|---|
| Polyester resin | 90 parts |
| Styrene-butyl acrylate copolymer resin | 10 parts |
| Magnetite fine powder | 40 parts |
| Polyethylene wax | 4 parts |
| Dimethyl 5-sulfoisophthalate barium salt | 4 parts |

Using the above ingredients, a toner was prepared in the same manner as described in Example 4. The toner thus obtained had a volume average particle diameter of 8.0±0.5 μm.

Evaluation

The toner obtained above was tested using a printing machine, IPSIO NX700 manufactured by Ricoh Company, Ltd. The printer had a one-component type developing device that required the developer to establish a properly charged state in a moment. Good images were obtained not only in the initial stage but also after production of 50,000 prints. The amount of charge of the toner sampled from a surface of the developing roller was −18 μC/g in the initial stage and was −18 μC/g after production of 50,000 prints. The printing operation was also carried out in a low temperature low humidity environment (10° C., 15% relative humidity) and in a high temperature high humidity environment (30° C., 90% relative humidity). Good images were obtained in these environments, too. The initial charge amount was −19 μC/g in the case of the conditions of 10° C. and 15% relative humidity and −17 μC/g in the case of the conditions of 30° C. and 90% relative humidity. Thus the developer was found to be hardly influenced by environmental conditions.

COMPARATIVE EXAMPLE 3

| Preparation of toner: | |
|---|---|
| Polyester resin | 100 parts |
| Magnetite fine powder | 40 parts |
| Polyethylene wax | 4 parts |
| Barium sulfate | 4 parts |

Using the above ingredients a toner was prepared in the same manner as described in Example 4.

Evaluation

The toner obtained above was tested in the same manner as described in Example 7. Images obtained in the initial stage were not uniform in image density. A toner thin layer formed on a surface of the developing roller was found to be irregular. The amount of charge of a toner sampled from the thin layer was −12 μC/g. When 50,000 sheets of images were produced, background stains were caused during the course of the printing operation. A toner thin layer formed on a surface of the developing roller after production of the 50,000 prints was found to be irregular. The amount of charge of a toner sampled from the thin layer was −5 μC/g. The printing operation was also carried out in a low temperature low humidity environment (10° C., 15% relative humidity) and in a high temperature high humidity environment (30° C., 90% relative humidity). Good images were not obtained in these environments. The initial charge amount was −14 μC/g in the case of the conditions of 10° C. and 15% relative humidity and −10 μC/g in the case of the conditions of 30° C. and 90% relative humidity.

EXAMPLE 8

| Preparation of toner: | |
|---|---|
| Polyester resin | 100 parts |
| Magnetite fine powder | 40 parts |
| Carnauba wax | 4 parts |
| Fluorine-containing quaternary ammonium salt | 1 part |

Using the above ingredients, a toner was prepared in the same manner as described in Example 7. The toner thus obtained had a volume average particle diameter of 8.0±0.5 μm.

Preparation of Developing Roller

A copying machine, M-10 manufactured by Ricoh Company, Ltd., was modified such that a metal roller of the developing roller was covered with a coating of an ion conductive solid rubber in which dimethyl 5-sulfoisophthalate barium salt was dispersed in an amount of 35 parts per 100 parts of the solid rubber.

Evaluation

The toner obtained above was charged in the above modified copying machine and copies were produced. Good images were obtained not only in the initial stage but also after production of 50,000 copies. The amount of charge of the toner sampled from a surface of the developing roller was +18 μC/g in the initial stage and was +15 μC/g after production of 50,000 copies. The copying operation was also carried out in a low temperature low humidity environment (10° C., 15% relative humidity) and in a high temperature high humidity environment (30° C., 90% relative humidity). Good images were obtained in these environments, too. The initial charge amount was +20 μC/g in the case of the conditions of 10° C. and 15% relative humidity and +17 μC/g in the case of the conditions of 30° C. and 90% relative humidity.

COMPARATIVE EXAMPLE 4

The toner obtained in Example 8 was charged in a copying machine, M-10 manufactured by Ricoh Company, Ltd., which was not modified. Background stains were caused in the initial stage. A toner thin layer formed on a surface of the developing roller was found to be irregular. The amount of charge of a toner sampled from the thin layer was +7 μC/g. Background stains were caused throughout the course of image reproduction for 50,000 copies. The amount of charge of a toner sampled from a thin layer formed on a surface of the developing roller after production of the 50,000 copies was +7 μC/g. The copying operation was also carried out in a low temperature low humidity environment (10° C., 15% relative humidity) and in a high temperature high humidity environment (30° C., 90% relative humidity). Good images were not obtained in these environments, either. The charge amount was +11 μC/g in the case of the conditions of 10° C. and 15% relative humidity and +7 μC/g in the case of the conditions of 30° C. and 90% relative humidity.

EXAMPLE 9

| Preparation of developer: | |
|---|---|
| Polyester resin | 70 parts |
| Styrene-butyl acrylate copolymer resin | 30 parts |
| Carbon black | 10 parts |
| Polyethylene wax | 4 parts |
| 5-Sulfoisophthalic acid barium salt | 1.5 parts |
| Salicylic acid zirconium salt | 1 part |

The above ingredients were thoroughly mixed using a HENSCHEL mixer and the mixture was kneaded with a roll mill at 130 to 140° C. for about 30 minutes. The kneaded mixture was solidified by cooling to room temperature and the solid mass was grounded and sieved to obtain base toner particles having a volume average particle diameter of 8.0±0.5 μm. 100 Parts of the base toner particles were mixed with 0.5 part of hydrophobic silica and 0.2 part of titanium oxide as external additives to obtain a toner. The toner (3 parts) was mixed with 97 parts of iron carrier having a particle size of 100 to 250 mesh using a TURBLER mixer to obtain a developer.

Evaluation

The developer obtained above was charged in a copying machine, MF-2200, manufactured by Ricoh Company, Ltd. and images were reproduced at room temperature environment. Uniform images having a high image density and free of background stains were obtained in the initial copying stage. No image defects were detected even after production of 50,000 copies. The toner during developing operations was measured for the static charge amount by a blow-off method to reveal that the initial charge amount was −28 μC/g and that the charge amount after production of 50,000 copies was −26 μC/g. Image reproduction was also carried out in a low temperature low humidity environment (10° C., 15% relative humidity) and in a high temperature high humidity environment (30° C., 90% relative humidity). Good images were found to be obtained in these environments, too. The toner during developing operations was measured for the static charge amount by a blow-off method to reveal that the initial charge amount was −30 μC/g in the case of the conditions of 10° C. and 15% relative humidity and −25 μC/g in the case of the conditions of 30° C. and 90% relative humidity. Thus the developer was found to be hardly influenced by environmental conditions.

EXAMPLE 10

| Preparation of developer: | |
|---|---|
| Polyester resin | 70 parts |
| Styrene-butyl acrylate copolymer resin | 30 parts |
| Carbon black | 10 parts |
| Polyethylene wax | 4 parts |
| Dimethyl 5-sulfoisophthalate barium salt | 2 parts |
| Salicylic acid zirconium salt | 0.5 part |

Using the above ingredients a toner was prepared in the same manner as described in Example 9. A developer was then prepared using the thus obtained toner.

Evaluation

The developer obtained above was tested in the same manner as that in Example 9. Uniform images having a high image density and free of background stains were obtained in the initial copying stage. No image defects were detected even after production of 50,000 copies. The initial charge amount was −28 μC/g and the charge amount after production of 50,000 copies was −26 μC/g. Image reproduction was also carried out in a low temperature low humidity environment (10° C., 15% relative humidity) and in a high temperature high humidity environment (30° C., 90% relative humidity). Good images were found to be obtained in these environments too. The initial charge amount was −29 μC/g in the case of the conditions of 10° C. and 15% relative humidity and −26 μC/g in the case of the conditions of 30° C. and 90% relative humidity. Thus the developer was found to be hardly influenced by environmental conditions.

EXAMPLE 11

| Preparation of developer: | |
|---|---|
| Yellow toner: | |
| Polyester resin | 100 parts |
| Disazo yellow pigment | 5 parts |
| 5-Sulfoisophthalic acid barium salt | 1.6 parts |
| 5-Chlorosalicylic acid zinc salt | 0.4 part |
| Magenta toner: | |
| Polyester resin | 100 parts |
| Quinacridon magenta pigment | 4 parts |
| 5-Sulfoisophthalic acid barium salt | 1.6 parts |
| 5-Chlorosalicylic acid zinc salt | 0.4 part |
| Cyan toner: | |
| Polyester resin | 100 parts |
| Copper phthalocyanin blue pigment | 2 parts |
| 5-Sulfoisophthalic acid barium salt | 1.6 parts |
| 5-Chlorosalicylic acid zinc salt | 0.4 part |
| Black toner: | |
| Polyester resin | 100 parts |
| Carbon black | 6 parts |
| 5-Sulfoisophthalic acid barium salt | 1.6 parts |
| 5-Chlorosalicylic acid zinc salt | 0.4 part |

The above ingredients of each of the toners were thoroughly mixed with a HENSCHEL mixer and the mixture was kneaded with a roll mill at 100 to 110° C. for about 30 minutes. The kneaded mixture was solidified by cooling to room temperature and the solid mass was grounded and sieved to obtain base toner particles having a volume average particle diameter of 8.0±0.5 μm. 100 Parts of the base toner particles were mixed with 0.7 part of hydrophobic silica and 0.6 part of titanium oxide as external additives to obtain a toner. The toner (5 parts) was mixed with 95 parts of iron carrier having a particle size of 100 to 250 mesh using a TURBLER mixer to obtain a developer. The above procedures were conducted for each of the four color toners to obtain four kinds of developer.

Evaluation

Each of the developers obtained above was charged in a copying machine, PRITER 550, manufactured by Ricoh Company, Ltd. and full color images were reproduced at room temperature environment. Uniform images having a high image density and good color tone and free of background stains were obtained in the initial copying stage. No image defects were detected even after production of 30,000 copies. The magenta toner during developing operations was measured for the static charge amount by a blow-off method to reveal that the initial charge amount was −23 μC/g and that the charge amount after production of 30,000 copies was −21 μC/g. Image reproduction was also carried out in a low temperature low humidity environment (10° C., 15% relative humidity) and in a high temperature high humidity environment (30° C., 90% relative humidity). Good images were found to be obtained in these environments, too. The toner during developing operations was measured for the static charge amount by a blow-off method to reveal that the initial charge amount was −26 μC/g in the case of the conditions of 10° C. and 15% relative humidity and −20 μC/g in the case of the conditions of 30° C. and 90% relative humidity. Thus the developer was found to be hardly influenced by environmental conditions.

EXAMPLE 12

| Preparation of developer: | |
|---|---|
| Yellow toner: | |
| Polyol resin | 100 parts |
| Disazo yellow pigment | 5 parts |
| Dimethyl 5-sulfoisophthalate barium salt | 1.8 parts |
| 3,5-dimethylsalicylic acid zinc salt | 0.2 part |
| Magenta toner: | |
| Polyol resin | 100 parts |
| Quinacridon magenta pigment | 4 parts |
| Dimethyl 5-sulfoisophthalate barium salt | 1.8 parts |
| 3,5-dimethylsalicylic acid zinc salt | 0.2 part |
| Cyan toner: | |
| Polyol resin | 100 parts |
| Copper phthalocyanin blue pigment | 2 parts |
| Dimethyl 5-sulfoisophthalate barium salt | 1.8 parts |
| 3,5-dimethylsalicylic acid zinc salt | 0.2 part |
| Black toner: | |
| Polyol resin | 100 parts |
| Carbon black | 6 parts |
| Dimethyl 5-sulfoisophthalate barium salt | 1.8 parts |
| 3,5-dimethylsalicylic acid zinc salt | 0.2 part |

Using the above ingredients, four kinds of toners were prepared in the same manner as described in Example 11. Four kinds of developers were then prepared in the same manner as described in Example 11.

Evaluation

Each of the developers obtained above was tested in the same manner as that in Example 11. Uniform images having a high image density and good color tone and free of background stains were obtained in the initial copying stage. No image defects were detected even after production of 30,000 copies. The magenta toner during developing operations was measured for the static charge amount by a blow-off method to reveal that the initial charge amount was −23 μC/g and that the charge amount after production of 30,000 copies was −22 μC/g. Image reproduction was also carried out in a low temperature low humidity environment (10° C., 15% relative humidity) and in a high temperature high humidity environment (30° C., 90% relative humidity). Good images were found to be obtained in these environments too. The toner during developing operations was measured for the static charge amount by a blow-off method to reveal that the initial charge amount was −25 μC/g in the case of the conditions of 10° C. and 15% relative humidity and −20 μC/g in the case of the conditions of 30° C. and 90% relative humidity. Thus the developer was found to be hardly influenced by environmental conditions.

EXAMPLE 13

| Preparation of developer: | |
|---|---|
| Yellow toner: | |
| Polyester resin | 100 parts |
| Disazo yellow pigment | 5 parts |
| Carnauba wax | 4 parts |
| Dimethyl 5-sulfoisophthalate barium salt | 1.9 parts |
| 3,5-di-t-butylsalicylic acid zinc salt | 0.1 part |
| Magenta toner: | |
| Polyester resin | 100 parts |
| Quinacridon magenta pigment | 4 parts |
| Carnauba wax | 4 parts |
| Dimethyl 5-sulfoisophthalate barium salt | 1.9 parts |
| 3,5-di-t-butylsalicylic acid zinc salt | 0.1 part |
| Cyan toner: | |
| Polyester resin | 100 parts |
| Copper phthalocyanin blue pigment | 2 parts |
| Carnauba wax | 4 parts |
| Dimethyl 5-sulfoisophthalate barium salt | 1.9 parts |
| 3,5-di-t-butylsalicylic acid zinc salt | 0.1 part |
| Black toner: | |
| Polyester resin | 100 parts |
| Carbon black | 6 parts |
| Carnauba wax | 4 parts |
| Dimethyl 5-sulfoisophthalate barium salt | 1.9 parts |
| 3,5-di-t-butylsalicylic acid zinc salt | 0.1 part |

Using the above ingredients, four kinds of toners were prepared in the same manner as described in Example 11. Four kinds of developers were then prepared in the same manner as described in Example 11.

Evaluation

Each of the developers obtained above was tested in the same manner as that in Example 11. Uniform images having a high image density and good color tone and free of background stains were obtained in the initial copying stage. No image defects were detected even after production of 30,000 copies. The magenta toner during developing operations was measured for the static charge amount by a blow-off method to reveal that the initial charge amount was −23 μC/g and that the charge amount after production of 30,000 copies was −23 μC/g. Image reproduction was also carried out in a low temperature low humidity environment (10° C., 15% relative humidity) and in a high temperature high humidity environment (30° C., 90% relative humidity). Good images were found to be obtained in these environments, too. The toner during developing operations was measured for the static charge amount by a blow-off method to reveal that the initial charge amount was −23 μC/g in the case of the conditions of 10° C. and 15% relative humidity and −20 μC/g in the case of the conditions of 30° C. and 90% relative humidity. Thus the developer was found to be hardly influenced by environmental conditions.

EXAMPLE 14

| Preparation of toner: | |
|---|---|
| Polyester resin | 100 parts |
| Magnetite fine powder | 40 parts |
| Ester wax | 4 parts |
| Dimethyl 5-sulfoisophthalate barium salt | 1.7 parts |
| 3,5-di-t-butylsalicylic acid zinc salt | 0.3 part |

Using the above ingredients, a toner was prepared in the same manner as described in Example 9. The toner thus obtained had a volume average particle diameter of 8.0±0.5 μm.

Evaluation

The toner obtained above was tested using a printing machine, IPSIO NX700 manufactured by Ricoh Company, Ltd. The printer had a one-component type developing device that required the developer to establish a properly charged state in a moment. Good images were obtained not only in the initial printing stage but also after production of 50,000 prints. The amount of charge of the toner sampled from a surface of the developing roller was −19 μC/g in the initial stage and was −19 μC/g after production of 50,000 prints. The printing operation was also carried out in a low temperature low humidity environment (10° C., 15% relative humidity) and in a high temperature high humidity environment (30°C., 90% relative humidity). Good images were obtained in these environments, too. The initial charge amount was −20 μC/g in the case of the conditions of 10° C. and 15% relative humidity and −17 μC/g in the case of the conditions of 30° C. and 90% relative humidity. Thus the developer was found to be hardly influenced by environmental conditions.

COMPARATIVE EXAMPLE 5

| Preparation of toner: | |
|---|---|
| Polyester resin | 100 parts |
| Magnetite fine powder | 40 parts |
| Ester wax | 4 parts |
| 5-Sulfoisophthalic acid sodium salt | 2.4 parts |
| Salicylic acid chromium salt | 0.6 part |

Using the above ingredients, a toner was prepared in the same manner as described in Example 10.

Evaluation

The toner obtained above was tested in the same manner as described in Example 10. Images obtained in the initial printing stage were good. A toner thin layer formed on a surface of the developing roller was found to be uniform. The amount of charge of a toner sampled from the thin layer was −20 μC/g. During the course of production of 50,000 prints, background stains began forming after production of 20,000 prints and continued forming thereafter. A toner thin layer formed on a surface of the developing roller after production of the 50,000 prints was found to be irregular. The amount of charge of a toner sampled from the thin layer was −14 μC/g. The printing operation was also carried out in a low temperature low humidity environment (10° C., 15% relative humidity) and in a high temperature high humidity environment (30° C., 90% relative humidity). Good images were not obtained in the high temperature high humidity environment. The initial charge amount was −22 μC/g in the case of the conditions of 10° C. and 15% relative humidity and −12 μC/g in the case of the conditions of 30° C. and 90% relative humidity.

EXAMPLE 15

| Preparation of toner: | |
|---|---|
| Polyester resin | 100 parts |
| Magnetite fine powder | 40 parts |
| Carnauba wax | 4 parts |
| Fluorine-containing quaternary ammonium salt | 0.7 part |

Using the above ingredients, a toner was prepared in the same manner as described in Example 9. The toner thus obtained had a volume average particle diameter of 8.0±0.5 μm.

Preparation of Developing Roller

A copying machine, M-10 manufactured by Ricoh Company, Ltd., was modified such that a metal roller of the developing roller was covered with a coating of an ion conductive solid rubber in which a mixture of 85% by weight of dimethyl 5-sulfoisophthalate barium salt and 15% by weight of 3,5-di-t-butylsalicylic acid zinc salt was dispersed in an amount of 35 parts per 100 parts of the solid rubber.

Evaluation

The toner obtained above was charged in the above modified copying machine and copies were produced. Good images were obtained not only in the initial stage but also after production of 50,000 copies. The amount of charge of the toner sampled from a surface of the developing roller was +17 $\mu$C/g in the initial stage and was +15 $\mu$C/g after production of 50,000 copies. The copying operation was also carried out in a low temperature low humidity environment (10° C., 15% relative humidity) and in a high temperature high humidity environment (30° C., 90% relative humidity). Good images were obtained in these environments, too. The initial charge amount was +18 $\mu$C/g in the case of the conditions of 10° C. and 15% relative humidity and +15 $\mu$C/g in the case of the conditions of 30° C. and 90% relative humidity.

COMPARATIVE EXAMPLE 6

The toner obtained in Example 15 was charged in a copying machine, M-10 manufactured by Ricoh Company, Ltd., which was not modified. Background stains were caused in the initial stage, A toner thin layer formed on a surface of the developing roller was found to be irregular. The amount of charge of a toner sampled from the thin layer was +6 $\mu$C/g. Background stains were caused throughout the course of image reproduction for 50,000 copies. The amount of charge of a toner sampled from a thin layer formed on a surface of the developing roller after production of the 50,000 copies was +5 $\mu$C/g. The copying operation was also carried out in a low temperature low humidity environment (10° C., 15% relative humidity) and in a high temperature high humidity environment (30° C., 90% relative humidity). Good images were not obtained in these environments, either. The charge amount was +7 $\mu$C/g in the case of the conditions of 10° C. and 15% relative humidity and +4 $\mu$C/g in the case of the conditions of 30° C. and 90% relative humidity.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

The teachings of Japanese Patent Applications No. 2002-172956 filed Jun. 7, 2001 and No. 2001-290197 filed Sep. 21, 2001, inclusive of the specification, claims and drawings, are hereby incorporated by reference herein.

What is claimed is:

1. A charge control agent comprising a barium salt of a sulfoisophthalic acid compound represented by the following formula (1):

(1)

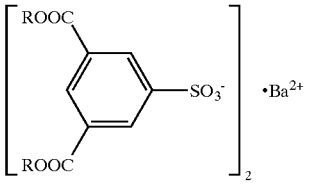

wherein R is a hydrogen atom or a hydrocarbyl group having 1 to 8 carbon atoms, and a metal salt of a salicylic acid compound, wherein the metal salt of the salicylic acid compound is other than a barium salt.

2. A charge control agent as claimed in claim 1, wherein R of formula (1) is a methyl group.

3. A charge control agent as claimed in claim 1, wherein the weight ratio of said barium salt of a sulfoisophthalic acid compound to said metal salt of a salicylic acid compound is greater than 1.

4. A charge control agent as claimed in claim 1, wherein said metal of said metal salt of a salicylic acid compound is selected from the group consisting of zinc, chromium and zirconium.

5. A charge control agent as claimed in claim 4, wherein said metal salt of a salicylic acid compound is a zinc salt of a salicylic acid compound.

6. A charge control agent as claimed in claim 5, wherein said zinc salt of a salicylic acid compound is represented by the following formula (3):

(3)

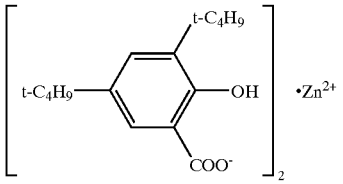

7. A toner for developing an electrostatic latent image, comprising a binder resin, a colorant and a charge control agent according to claim 1.

8. A toner as claimed in claim 7, wherein said binder resin comprises a resin selected from the group consisting of polyester resins, epoxy resins and polyol resins obtained from epoxy resins.

9. A toner as claimed in claim 7, wherein said colorant is selected from the group consisting of magenta colorants, cyan colorants, yellow colorants and black colorants.

10. A toner for developing an electrostatic latent image, comprising a binder resin, a colorant and a charge control agent comprising a barium salt of a sulfoisophthalic acid compound represented by the following formula (1):

(1)

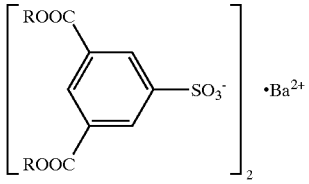

wherein R is a hydrogen atom or a hydrocarbyl group having 1 to 8 carbon atoms.

11. A toner as claimed in claim 10, wherein said binder resin comprises a resin selected from the group consisting of polyester resins, epoxy resins and polyol resins obtained from epoxy resins.

12. A toner as claimed in claim 10, wherein said colorant is selected from the group consisting of magenta colorants, cyan colorants, yellow colorants and black colorants.

* * * * *